US012630996B2

(12) United States Patent
Thompson

(10) Patent No.: US 12,630,996 B2
(45) Date of Patent: May 19, 2026

(54) ADAPTER BRACKET FOR COUPLING A WORK TOOL AND A WORK MACHINE

(71) Applicant: Caterpillar Inc., Peoria, IL (US)

(72) Inventor: Mark W. Thompson, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 685 days.

(21) Appl. No.: 18/154,408

(22) Filed: Jan. 13, 2023

(65) Prior Publication Data

US 2024/0240428 A1 Jul. 18, 2024

(51) Int. Cl.
*E02F 3/36* (2006.01)

(52) U.S. Cl.
CPC ..... *E02F 3/3686* (2013.01)

(58) Field of Classification Search
CPC ..... E02F 3/3636; E02F 3/3686; E02F 3/369; E02F 3/3604; E02F 3/3609; E02F 3/3613; E02F 3/3618; E02F 3/3622; E02F 3/3627; E02F 3/3631; E02F 3/364
See application file for complete search history.

(56) References Cited

U.S. PATENT DOCUMENTS 3,874,533 A * 4/1975 Montgomery ..... E02F 3/3631 414/723
4,871,292 A 10/1989 Milanowski
5,145,313 A * 9/1992 Weyer ..... E02F 3/3677 37/468
5,156,215 A * 10/1992 Jensen ..... B62D 49/085 37/366
5,195,865 A * 3/1993 Koehl ..... E02F 3/405 414/723
5,332,353 A * 7/1994 Arnold ..... E02F 3/3622 172/275
5,382,110 A * 1/1995 Perotto ..... E02F 3/3663 403/322.3
5,515,626 A * 5/1996 Holscher ..... E02F 3/3677 37/468
5,533,682 A * 7/1996 de Gier ..... E02F 3/3631 241/266
5,546,683 A * 8/1996 Clark ..... E02F 3/3631 37/468
5,692,852 A * 12/1997 Collins ..... E02F 3/3622 37/468

(Continued)

FOREIGN PATENT DOCUMENTS

GB 2429197 2/2007

OTHER PUBLICATIONS

Written Opinion and International Search Report for Int'l. Patent Appln. No. PCT/US2024/010387, mailed Apr. 29, 2024 (12 pgs).

*Primary Examiner* — Jamie L McGowan

(57) ABSTRACT

An adapter bracket can releasably couple a work tool having a connection interface with first and second linkage pins to an implement arm on a work machine. The adapter bracket can include an upper arm interface and a lower tool interface. The tool interface can include a first or forward pin opening to receive the first linkage pin and a second or rearward pin opening to receive the second linkage pin. The first pin opening can be a multi-radii pin opening for linkage pins of different pin diameters and the second pin opening can be a span channel for different pin spans.

20 Claims, 8 Drawing Sheets

(56) References Cited

U.S. PATENT DOCUMENTS 5,927,665 A * 7/1999 Grabnic ..... E02F 3/3604 403/4
5,951,192 A * 9/1999 Collins ..... E02F 3/3636 403/150
5,971,455 A 10/1999 Wolin et al.
5,975,604 A * 11/1999 Wolin ..... E02F 3/4135 294/198
6,158,917 A * 12/2000 Wolin ..... E02F 3/3636 37/456
D440,983 S * 4/2001 Miller ..... E02F 3/58 D15/28
6,312,212 B1 * 11/2001 Burlew, Jr. ..... E02F 3/3631 37/468
6,364,561 B1 * 4/2002 Droegemueller ..... E02F 3/967 403/336
6,379,075 B1 * 4/2002 Shamblin ..... E02F 3/3663 37/468
6,533,529 B2 * 3/2003 Waggoner ..... B66C 1/62 403/4
6,659,708 B2 * 12/2003 Heiple ..... E02F 3/3618 403/321
6,662,681 B2 * 12/2003 Crane ..... E02F 3/966 37/444
6,881,002 B2 4/2005 Fatemi
6,938,514 B1 9/2005 Crane et al.
6,962,475 B2 11/2005 Fatemi
7,770,311 B2 * 8/2010 Hahnel ..... E02F 3/3609 37/444
7,797,862 B2 * 9/2010 Daraie ..... E02F 3/3622 37/468
8,869,437 B2 * 10/2014 Robl ..... E02F 3/3618 37/468
9,163,378 B2 * 10/2015 Doan ..... E02F 3/58
10,113,301 B2 * 10/2018 Hedlund ..... F16C 11/10
10,364,545 B2 * 7/2019 Gonzalez ..... E02F 3/3613
10,385,535 B2 * 8/2019 Gonzalez ..... F16C 11/045
12,065,802 B2 * 8/2024 Kollmann ..... E02F 3/3636
2003/0131682 A1 * 7/2003 Crane ..... E02F 3/3613 403/167
2008/0083144 A1 * 4/2008 Sederberg ..... E02F 3/3604 37/468
2009/0084005 A1 * 4/2009 Ramun ..... E02F 3/3604 37/468
2013/0160269 A1 6/2013 Parker et al.
2014/0212210 A1 * 7/2014 Robl ..... E02F 3/3636 403/345
2014/0306426 A1 * 10/2014 Guethle ..... B62D 12/00 280/442
2015/0122519 A1 * 5/2015 Bodnaryk ..... A01B 35/225 403/14
2020/0299922 A1 * 9/2020 Sato ..... E02F 3/369
2021/0270005 A1 * 9/2021 Kollmann ..... E02F 3/3636
2022/0063971 A1 * 3/2022 Narayanan ..... B66F 9/12
2022/0307220 A1 * 9/2022 Tanaka ..... E02F 3/3636
2024/0102260 A1 * 3/2024 Mrozek ..... E02F 3/3686
2024/0240428 A1 * 7/2024 Thompson ..... E02F 3/3604

* cited by examiner

ADAPTER BRACKET FOR COUPLING A WORK TOOL AND A WORK MACHINE

TECHNICAL FIELD

This patent disclosure relates generally to couplers for coupling a work tool to the implement arm of a work machine and, more particularly, to an adapter bracket for accommodating work tools having different pin diameters and pin spans and spreads.

BACKGROUND

Various types of work machines in the construction, mining, and agricultural fields such as, for example, excavators may include an elongated and power drive implement arm that can be configured to articulate and that can be coupled at its distal end to a work tool. The implement arm can be articulated to spatially move the work tool in order conduct an operation. For example, the work tool may be a bucket that is maneuvered by the implement arm to conduct a digging or excavating operation.

It is often desirable for the same work machine to change between different work tools to conduct different tasks. For example, buckets of different dimensions, sizes, and configurations may be desired depending upon the operation and the material being excavated. Different types of work tools may also be desired for different operations such as rippers, augers, pneumatic and hydraulic hammers, vibratory compactors, etc. Accordingly, the work machines and the work tools are often configured for exchangeability by enabling the two devices to couple and decouple with respect to each other.

A conventional design for enabling the coupling and decoupling of a work tool from a machine is a pin grabber coupler. Two parallel but spaced apart linkage pins are retained in a bracket structure centrally located on the rear or top of the work tool. A corresponding coupler or pin grabber may be attached at the distal end of the implement arm and may include a forward latching mechanism and a rearward latching mechanism that are spaced apart to correspond with the span of the linkage pins. When the pin grabber is moved proximate to the pin bracket, the forward and rearward latching mechanism can be actuated, for example, hydraulically to lock the implement arm to the work tool. Conversely, when it is desired to release the work tool, the forward and rearward latching mechanisms can be de-actuated releasing the linkage pins.

A difficulty that arises with pin grabber couplers is that the pin diameter and the pin spans, which refers to the center-to-center distance between the two linkage pins, may vary between work tools and especially between different manufacturers of work tools. Therefore, it may be necessary to use adapters and the like to enable the coupling between different work tools and the corresponding interfaces on the implement arms. The present disclosure is directed to an adapter bracket configured to accommodate work tools having different pin diameters and different pin spans.

SUMMARY

The disclosure describes, in one aspect, an adapter bracket for coupling an implement arm of a work machine and a work tool via a connecting interface with first and second parallel and spaced-apart linkage pins. The adapter bracket includes an adapter body having an arm interface for connection to the implement arm and a tool interface for releasable connection to the work tool. The tool interface further has at least one first pin opening and at least one second pin opening for receiving the first and second linkage pins.

In another aspect, there is disclosed a coupler system for coupling an implement arm of a work machine and a work tool. The work tool can have a connection interface including a first linkage pin and a second linkage pin in a parallel, spaced apart arrangement. To couple to the connection interface, the adapter bracket can include an adapter body having a tool interface and an arm interface for connection to the implement arm. To securely receive the first linkage pin and the second linkage pin, the tool interface can also have a first pin opening and a second pin opening in which the linkage pins are received.

In a further aspect, the disclosure describes an adapter bracket for coupling an implement arm of a work machine and a work tool. To connect with the implement arm, the adapter bracket includes an upper arm interface having a first upper sidewall and a second upper sidewall in a spaced apart relation with arm hooks. To releasable connect to the connection interface on the work tool that may have first and second linkage pins in a parallel, spaced apart relation, the adapter bracket also includes a lower tool interface having a first lower sidewall and a second lower sidewall in a spaced apart relation and parallel to the first upper sidewall and the second upper sidewall. The lower tool interface includes a first pin opening configured as a multi-radii pin opening and a second pin opening configured as a span channel having a channel length dimensionally greater than a channel height.

DETAILED DESCRIPTION

Figure 1:
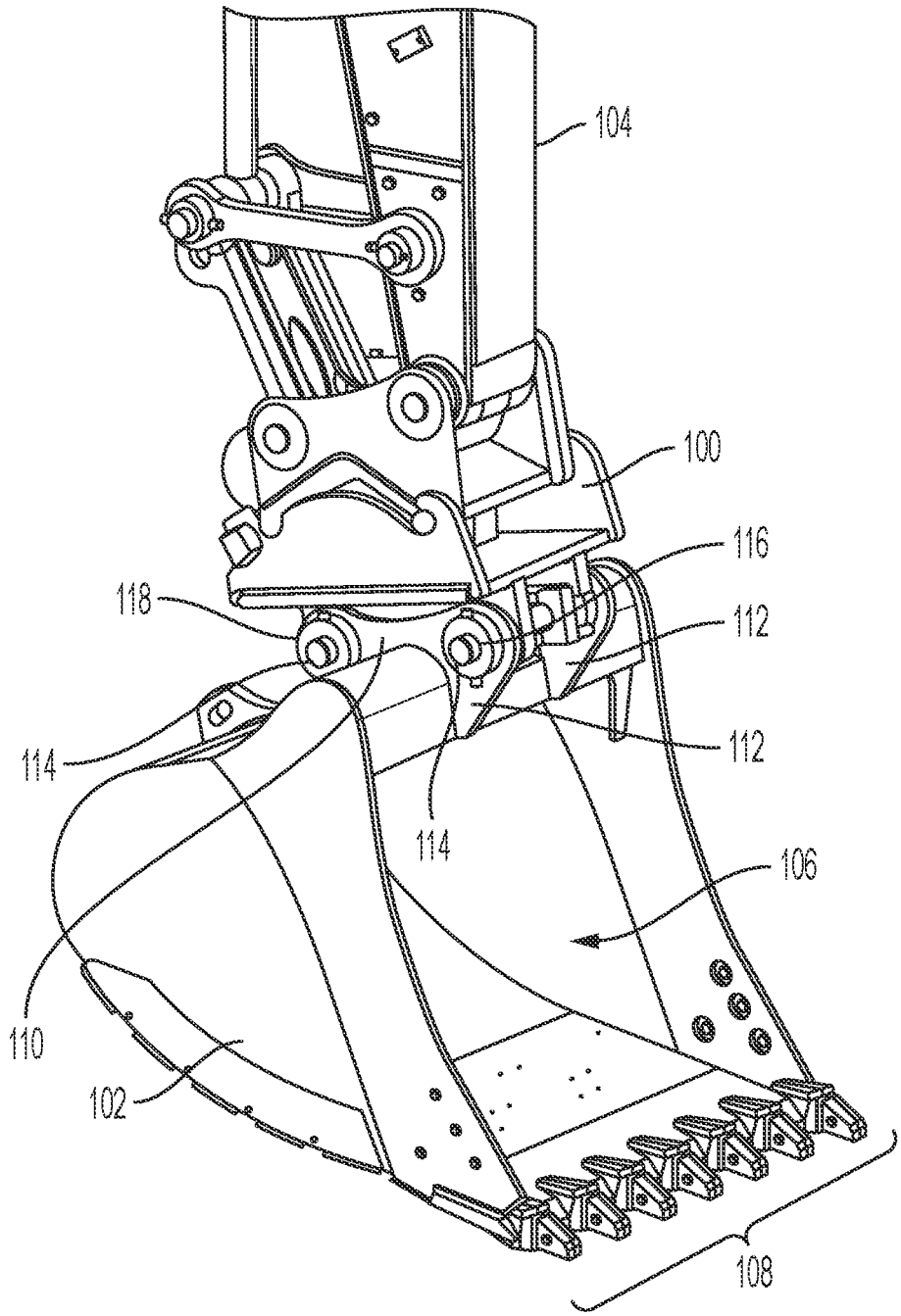
FIG. 1 is as isometric view of an adapter bracket of the present disclosure coupling together the implement arm of a work machine with the connection interface of a work tool.

Now referring to the figures, wherein whenever possible like reference numbers refer to like elements, there is illustrated an adapter bracket 100 that can operatively couple a work tool 102 to the distal end of an implement arm 104 of a work machine in accordance with the disclosure. A work machine of the present embodiment may be an excavator or another type of construction or material handling equipment used to conduct operations such as digging, planning, drilling, material removal and replacement, lifting, hauling, demolition, and the like in the construction, mining, agriculture, landscaping, or similar fields. The work machine may be a mobile work machine and may include an undercarriage supported on continuous tracks or wheels for mobile propulsion about a work site. In other embodiments, the work machine may be stationary in a fixed location, such as a crane. In the illustrated embodiment, the work tool 102 is a bucket which is a rigid structure defining an opened inner volume 106 that can receive and contain material during a digging or material transfer operation. The bucket may include a leading cutting edge 108 with a plurality of protruding teeth in a straight-line arrangement to penetrate into the material of the operation. Other examples of work tools in accordance with the disclosure include rippers, augers, drills, pneumatic or hydraulic hammers, vibratory compactors and the like.

To spatially move the work tool 102 through a range of motion during an operation, the implement arm 104 can be a mechanical linkage having a plurality of rigid links pivotally joined by a plurality of resolute joints that allow for relative rotation of two joined links. To power articulation of the joints and relative rotation of the links, the implement arm 104 can be operatively associated with one or more hydraulic actuators that can telescopically extend and retract a piston rod from a cylinder barrel. The piston rod is fixed at one end to a first of the links and the cylinder barrel to a second link such that extension and retraction of the hydraulic actuator causes pivotal articulation of the joined links and motion of the implement arm 104.

To connect the work tool 102 to the distal end of the implement arm 104, the work tool can be configured with a connection interface 110 that is a structure formed on the rear or top of the body of the work tool. In the illustrated embodiment, the connection interface 110 can be pin bracket including a first and a second spaced apart bracket flanges 112. Two pairs of aligned pin holes 114 can be disposed through the bracket flanges 112 and can slidably receive a respective first linkage pin 116 and a second linkage pin 118. The linkage pins 116, 118 are cylindrical rods with a diameter corresponding to the diameter of the pin holes 114 and that are supported at either end by the spaced apart bracket flanges 112. The first and second linkage pins 116, 118 are therefore constrained in a parallel and spaced apart arrangement with the first linkage pin 116 located forward of the second linkage pin 118. The mid-length extension of the first and second linkage pins 116, 118 that spans between the spaced apart bracket flanges 112 holding and supporting the distal ends of the linkage pins is generally exposed and can be accessed by a coupler such as a pin grabber that can latch to the first and second linkage pins 116, 118 with forward and rearward latching mechanisms as described above. While the illustrated work tool 102 includes a connection interface 110 in the embodiment of a pin bracket, the work tool 102 may also have other connection interfaces with different structures and different latching arrangements.

The adapter bracket 100 can be configured to enable the implement arm 104 to connectively couple with the different dimensional arrangements of the connection interface 110 on the work tool 102 and thereby enable the implement arm to attach to different work tools including those from different manufacturers. For example, the first and second linkage pins 116, 118 may have different diameters and/or the center-to-center distances between the parallel and spaced apart first and second linkage pins 116, 118, referred to herein as there pin span. Accordingly, the adapter bracket 100 is operatively situated intermediately between the work tool 102 and the implement arm 104 and can establish a separate and independent mechanical connection with each element. The adapter bracket 100 can statically secure the work tool 102 to the implement arm 104 while conducting operations like digging and lifting.

Figure 2:
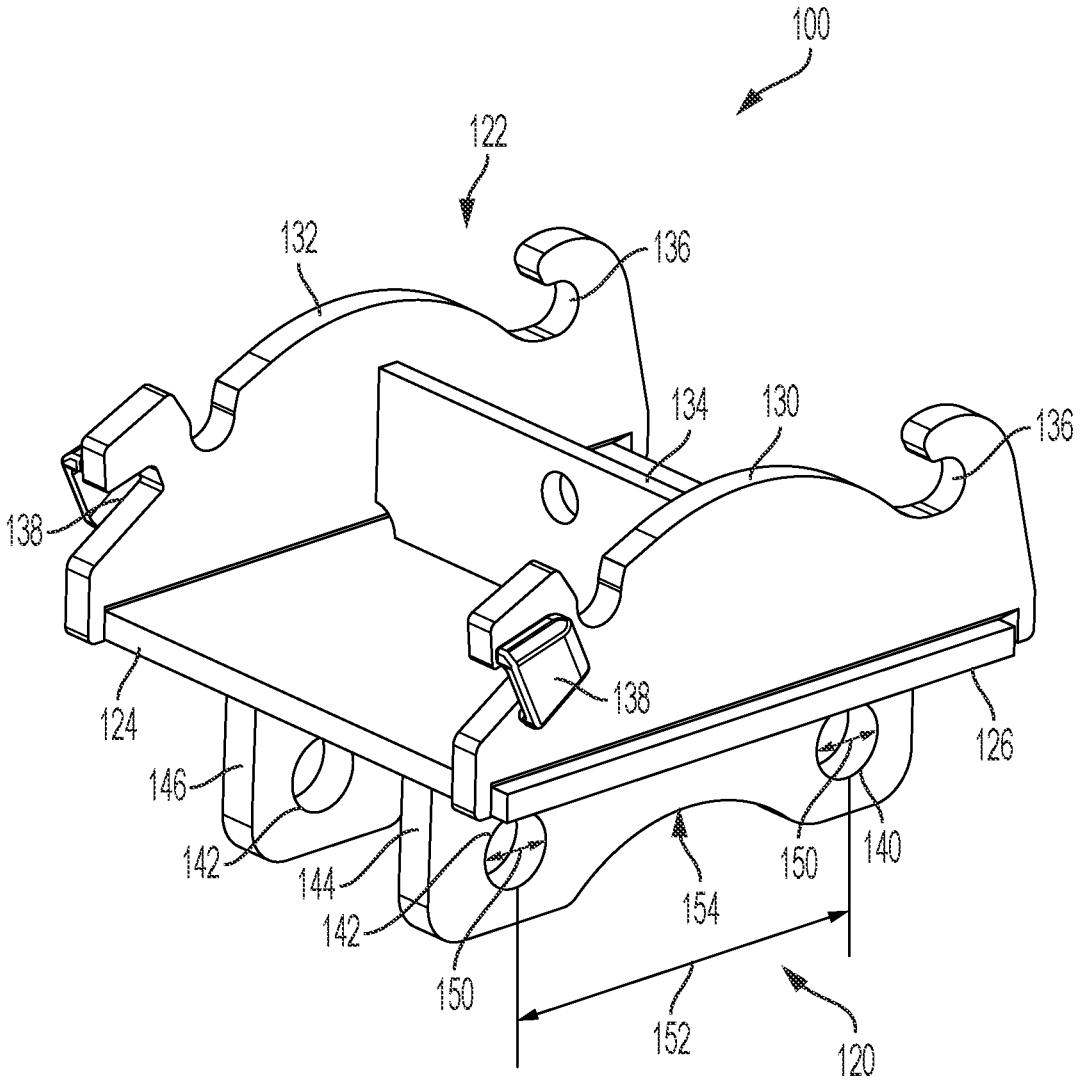
FIG. 2 is an isometric view of an embodiment of the adapter bracket including an upper arm interface for attaching to an implement arm and a lower tool interface having pin openings for receiving linkage pins on a work tool.

Referring to FIG. 2, there is illustrated an embodiment of the adapter bracket 100 for releasably coupling the work tool to the implement arm. To mechanically connect with the connection interface of the work tool, the adapter bracket 100 includes tool interface 120, and to mechanically connect with the distal end of the implement arm, the adapter bracket 100 includes an arm interface 122. The tool interface 120 and the arm interface 122 can be joined at an adapter plate 124, which may be a flat, planar plate that is intermediately disposed between the two structures such that the lower tool interface 120 is located below and underneath the upper arm interface 122. The lower tool interface 120, upper arm interface 122, and the intermediate adapter plate 124 structurally form a rigid adapter body 126 of the adapter bracket 100 which may be made from steel or a similar rigid material of sufficient structural strength. The elements of the adapter body 126 may be rigidly and integrally joined together, for example, by being constructed as an integral single casting or may be independently constructed and joined by welding, bracing and the like.

In the illustrated example, the arm interface 122 can include a first upper sidewall 130 and a second upper sidewall 132 that are parallel to and spaced apart from each other. For rigidity and support, the arm interface 122 may also include a bracing plate 134 that extends between and is joined with the first and second upper sidewalls 130, 132 and which is normal or perpendicular to the adapter plate 124. The first and second upper sidewalls 130, 132 are flat planar plates and may have a shape or contour to facilitate connection to the implement arm. For example, the first and second upper sidewalls 130, 132 may each include a forward arm hook 136 and a rearward arm hook 138. The forward arm hooks 136 of the first and second upper sidewalls 130 are aligned with each other in the spaced apart arrangement and the rear arm hooks 138 of the first and second upper sidewalls 130, 132 are likewise aligned with each other in the spaced apart arrangement. The forward and rearward arm hooks 136, 138 can be arranged and shaped to hook onto and securely engage with protruding knobs or lug bosses located on the implement arm. The distal end of the implement arm can be inserted and secured between the first and second upper sidewalls 130, 132 by the forward and rearward arm hooks 136, 138. In other embodiments of the adapter bracket 100, the arm interface 122 may have a different structure and connection mechanism that may be used to attach the adapter bracket 100 to the implement arm.

To operatively interact with the connection interface of the work tool, the lower tool interface 120 protrudes below the adapter plate 124 and can include at least a first or forward pin opening 140 and a second or rearward pin opening 142 that are dimensioned and arranged to recievably engage with the first and second linkage pins described above. In the illustrated embodiment, the forward pin opening 140 and the rearward pin opening 142 can be disposed and defined in a first lower sidewall 144 and a parallel, spaced apart second lower sidewall 146. The first lower sidewall 144 and the second lower sidewall 146 can be formed as flat, planar plates like the first and second upper sidewalls 130, 132 and may be aligned in parallel with the first and second upper sidewalls 130, 132. The first and second lower sidewalls 144, 146 can be generally rectangular in shape and can have a dimensional thickness selected to impart structural strength to support the linkage pins within the first and second pin openings 140, 142. Because of the inclusion of the first and second lower sidewalls 144, 146, the tool interface 120 consequentially includes a pair of axially aligned forward pin openings 140 and a pair of aligned rearward pin openings 142 that are spaced apart from each other by the relative spatial distance between the first and second lower sidewalls 144, 146. In other embodiments, the tool interface 120 can be configured as a single, integral block depending from the adapter plate 124 such that the tool interface 120 only includes a single forward pin opening 140 and a single rearward pin opening 142.

The forward and the rearward pin openings 140, 142 can be generally circular in shape and can have a pin opening diameter 150 dimensioned to form a sliding fit with the respective first and second linkage pins on connection interface of the work tool. In particular, the pin opening diameter 150 and the shape of the forward and rearward pin openings 140, 142 are circumferentially defined by the surrounding material of the first and second lower sidewalls 144, 146. The spaced apart arrangement of the pair of forward pin openings 140 and the pair of rearward pin openings 142 enable the linkage pins to be securely engaged toward their pin ends with the intermediate length of the linkage pins extending between the spaced apart first and second lower sidewalls 144, 146. To accommodate the pin span between the first and second linkage pins, the forward and rearward pin openings 140, 142 may be spaced apart from each other by a span distance 152. The span distance 152 may be the dimensional distance between the center of the forward pin openings 140 and the rearward pin openings 142 as disposed in and defined by the dimensional length of the first and second lower sidewalls 144, 146. The span distance 152 can be selectively configured to dimensionally correspond with the pin span of the linkage pins.

In the illustrated embodiment, the first and second lower sidewalls 144, 146 can include a downward clearance cutout 154 that is disposed into the rectangular shape of the lower sidewalls 144, 146 from the lower edges thereof. The clearance cutout 154 may be curved in shape and can generally arch between the forward pin openings 140 and the rearward pin openings 142. The curved clearance cutout 154 provides the first and second lower sidewalls 144, 146 with a profile or contour that enables the lower sides to interact with corresponding additional structures that may be included on the work tool. For example, in an embodiment, the connection interface of the work tool may include gussets or torsion bars as additional structures to add strength and rigidity thereto and the downward curved clearance cutouts 154 may enable the first and second lower sidewalls to operatively clear and avoid such obstructions.

The first embodiment of the adapter bracket 100 described in connection with FIG. 2 is characterized as including a lower tool interface 120 having a pair of forward pin openings 140 and a pair of rearward pin openings 142 of a generally consistent circular pin opening diameter 150 and spaced apart from each other by a span distance 152 to receive and securely engage the linkage pins of a work tool.

Figure 3:
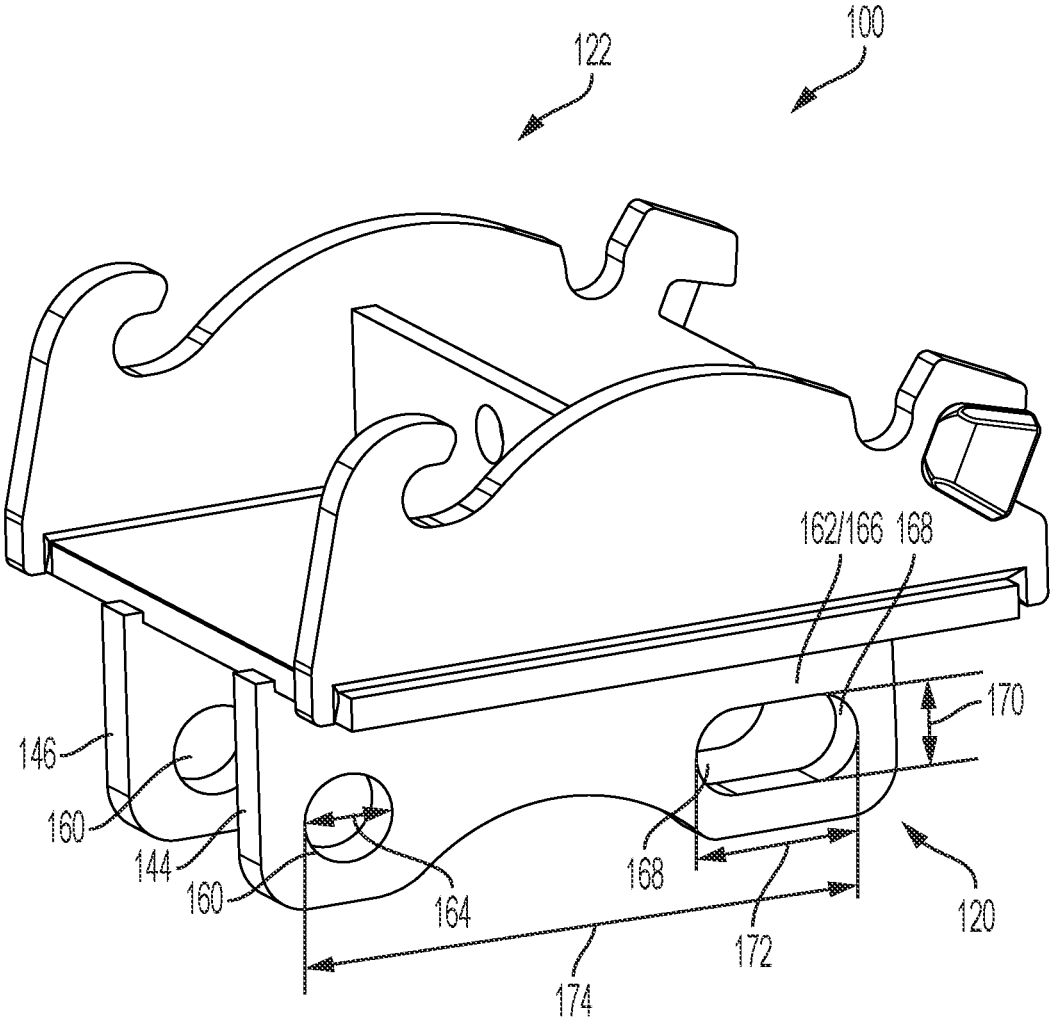
FIG. 3 is an isometric view of an embodiment of the adapter bracket wherein the rearward pin opening is configured as a span channel.

Referring to FIG. 3, there is illustrated another embodiment of the adapter bracket 100 configured to further accommodate different dimensional arrangements of the linkage pins on a work tool. Similar to the previous embodiment, the adapter bracket 100 can include a lower tool interface 120 having a first lower sidewall 144 and a second lower sidewall 146 in a parallel, spaced apart arrangement, although in other embodiments, the tool interface 120 can be configured as a single, integral block. To receive the linkage pins, a pair of forward pin openings 160 and a spaced apart pair of rearward pin opening 162 are disposed in the first and second lower sidewalls 144, 146. The respective pairs of forward and rearward pin openings 160, 162 are axially aligned with each other so that a linkage pin can be inserted though each respective pair.

The forward pin openings 160 can be generally circular in shape and can have a pin opening diameter 164 that dimensionally corresponds with the diameter of the linkage pins. To accommodate variability in pin spans, the rearward pin openings 162 in contrast can each be shaped as an elongated span channel 166 that extends between opposing first and second channel ends 168. The span channel 166 can have slot-like configuration that is disposed through the material of the first and second lower sidewalls 144, 146 and can have a first dimension, for example, a channel height 170 and a second dimension, for example, a channel length 172 that is greater than the height 170. The channel height 170 may generally correspond in dimension to the diameter of the linkage pins so that, when engaged, the linkage pins are vertically constrained within the span channels 166. The channel ends 168 of the span channels 166 can also be rounded so that the linkage pins can seatingly abut with the channel ends 168 when moved proximate thereto.

The channel length 172, being greater than the diameter of the linkage pins, allows for the linkage pins to be positioned at different locations within the span channels 166. The linkage pins can freely slide within the channel length 172 defined by the span channel 166. Because the span channels 166 can accommodate the linkage pins at different locations along the channel length 172, the tool interface 120 of the present embodiment can connectively engage with work tools having connection interfaces with differing and varying pin spans. The span distance 174 of the present embodiment of the adapter bracket 100 is a variable span distance because of the span channels 166, in contrast to the generally fixed span distance 152 illustrated with respect to FIG. 2.

The second embodiment of the adapter bracket 100 described in connection with FIG. 3 is therefore characterized as including a lower tool interface 120 having a pair of forward pin openings 160 of a generally circular pin opening diameter 164 and a pair of rearward pin openings 162 that are configured as span channels 166 with an associated channel length 172 that creates a variable span distance 174 to connectively engage with work tools of differing pin spans. In further embodiments, both the forward and rearward pin openings 160, 162 may be configured as span channels.

Figure 4:
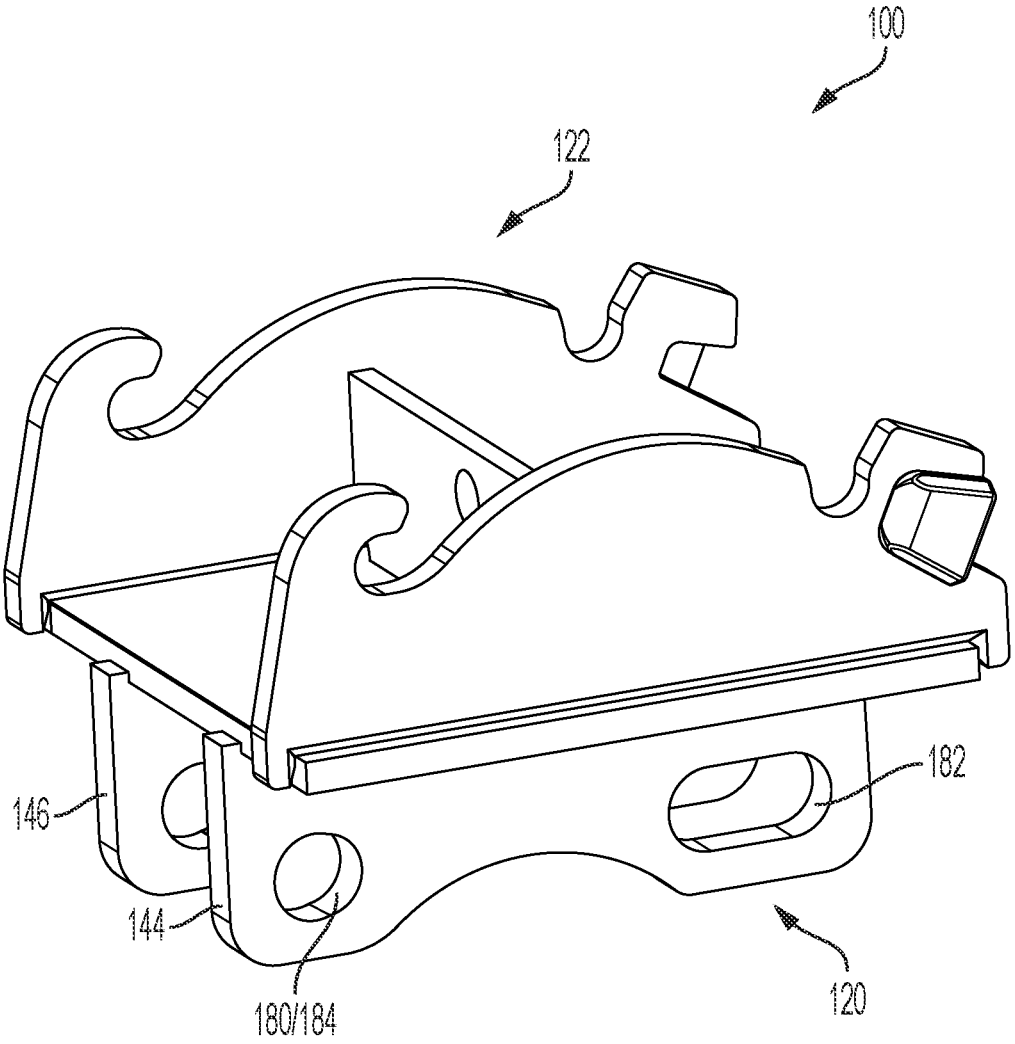
FIG. 4 is an isometric view of an embodiment of the adapter bracket wherein the forward pin opening is configured as a multi-radii opening.

Referring to FIG. 4, there is illustrated another embodiment of the adapter bracket 100 configured to further accommodate linkage pins having different pin diameters. Similar to the previous embodiments, the adapter bracket 100 can include a lower tool interface 120 having a first lower sidewall 144 and a second lower sidewall 146 in a parallel, spaced apart arrangement. To receptively engage the linkage pins, the present embodiment of the adapter bracket 100 includes a pair of forward pin openings 180 and a spaced apart pair of rearward pin openings 182. The rearward pin openings 182 may be configured as span channels as described above. The forward pin openings 180 in contrast may configured as a multi-radii pin opening 184 configured to securely engage with linkage pins of different pin diameters.

Figure 5:
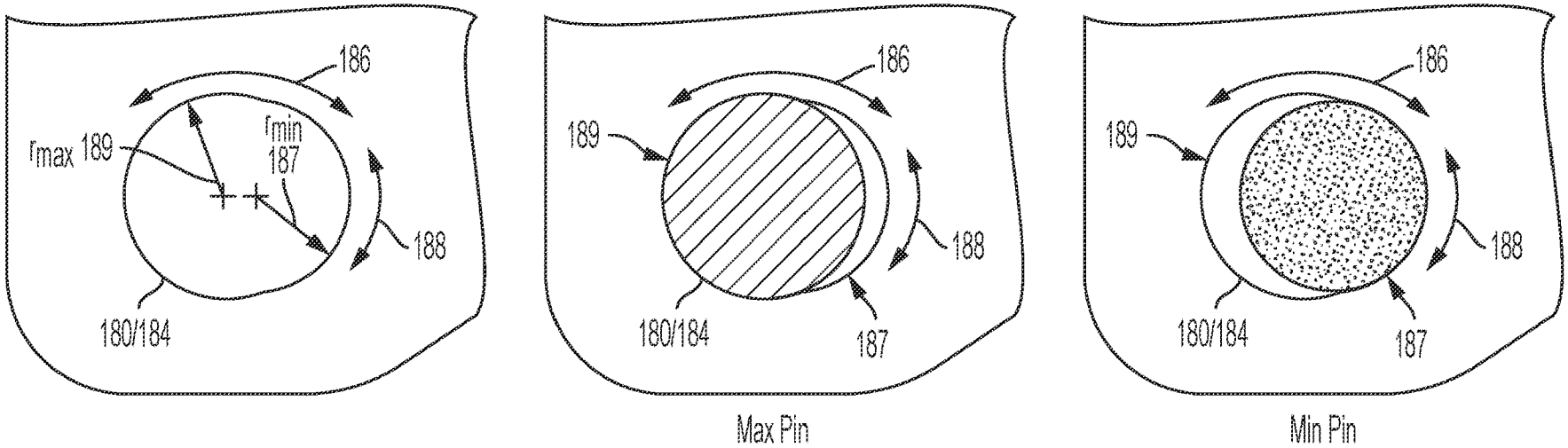
FIG. 5 is a detailed view of the multi-radii opening of FIG. 4 with a first arc having a first radius and a second arc having a second radius accommodating maximum and minimum diameter linkage pins.

Referring to FIG. 5, the multi-radii pin opening 184 can have a first arc 186 and a second arc 188 that correspond to the circumferential edge of the multi-radii pin opening 184. The first arc 186 may be associated with a first radius 187 that may be characterized as a minimum radius Imin and the second arc may be associated with a second radius 189 that may be characterized as a maximum radius $r_{max}$. The inner circumferential edge of the multi-radii pin opening 184 can transition in radial dimension between the first and second radii 187, 189 associated with the respective first and second arcs 186, 188. When a linkage pin having a minimum radius corresponding to the first radius $r_{min}$ 187 is received within the multi-radii pin opening 184, the cylindrical exterior surface of the linkage pin can seatingly abut and engage with the circumferential edge of the first arc 186 along multiple points of contact (configuration to the right). When a linkage pin having a maximum radius corresponding to the second radius max 189 is received within the multi-radii pin opening 184, its cylindrical exterior can seatingly abut and engage with the second arc 188 along multiple points of contact (configuration to the middle). Linkage pins having diameters between the minimum radius and the maximum radius can be received in the multi-radii pin opening 184 and seatingly abut against the transition positions along the inner circumferential edge between the first arc 186 and the second arc 188.

The third embodiment of the adapter bracket 100 described in connection with FIGS. 4 and 5 is therefore characterized as including a lower tool interface 120 having a pair of forward pin openings 160 configured as multi-radii pin openings 184 having at least first and second arcs 186, 188 with respective first and second radii 187, 188 that can receive and seatingly engage along multiple points of contact with linkage pins of different pin diameters. The rearward pin openings 12 of the third embodiment can be configured as elongated span channels. In other embodiments, both the forward and rearward pin openings 160, 162 may be multi-radii pin openings.

Figure 6:
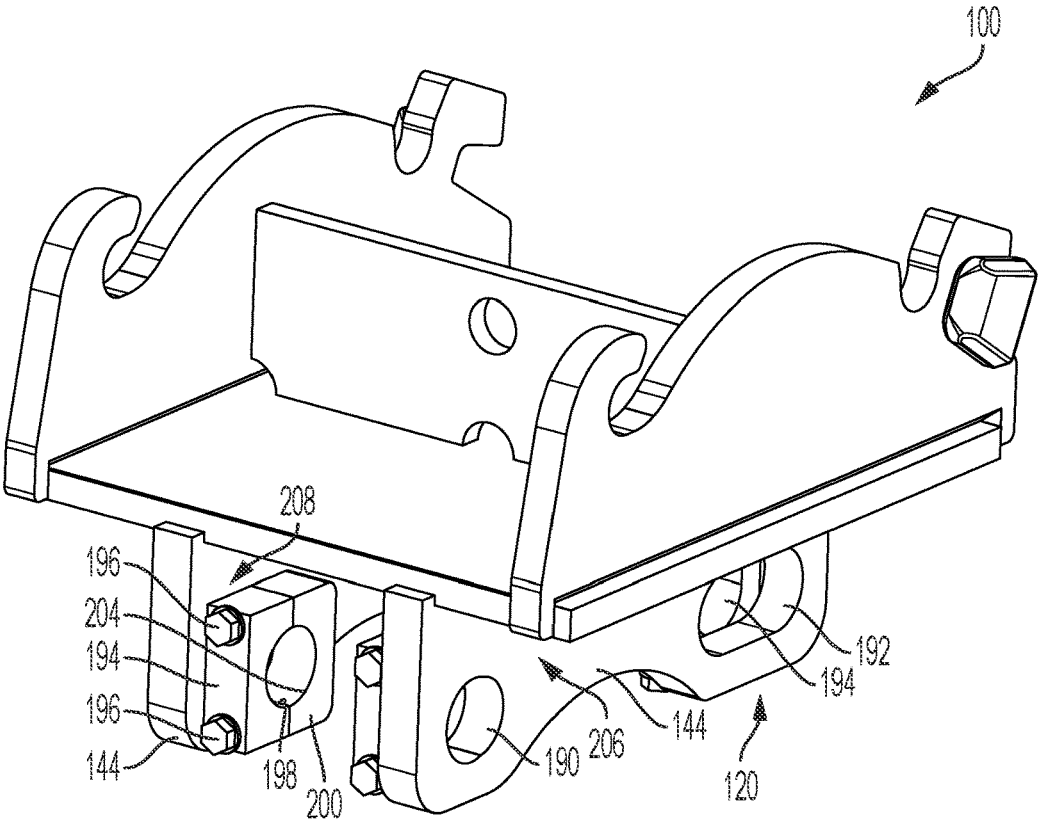
FIG. 6 is a forward isometric view of an embodiment of the adapter bracket configured with pin clamps for securing the linkage pins in the forward and rearward pin openings.
Figure 7:
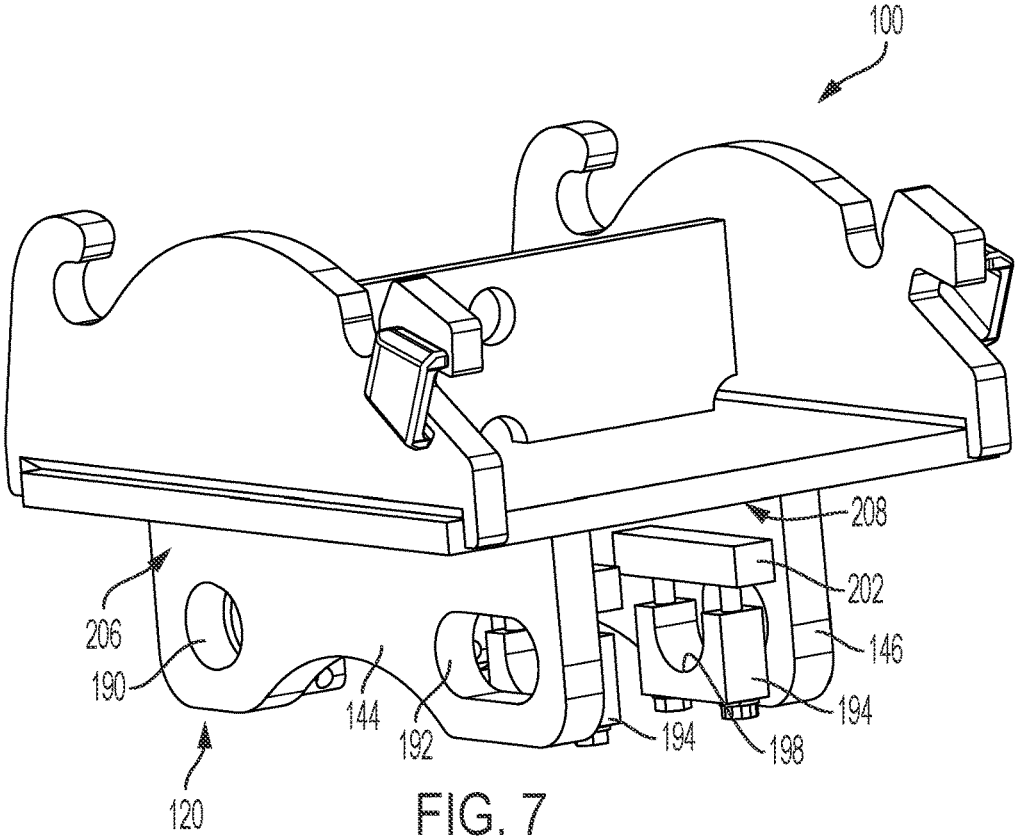
FIG. 7 is a rearward isometric view of the adapter bracket of FIG. 6.

Referring to FIGS. 6 and 7, there is illustrated an embodiment of the adapter bracket 100 configured to clamp the linkage pins within the forward pin opening 190 and the rearward pin opening 192. Similar to the previous embodiments, the adapter bracket 100 can include a lower tool interface 120 having a first lower sidewall 144 and a second lower sidewall 146 in a parallel, spaced apart arrangement though in other embodiments the lower tool interface may be configured as single integral block. The pair of forward pin openings 190 are disposed through the forward portions of the first and second lower sidewalls 144, 146 and the pair of rearward pin openings 192 are disposed through the rearward portion of the first and second lower sidewalls 144, 146. The forward pin openings 190 can be multi-radii pin openings having at least first and second arcs as described above and the rearward pin openings 192 can be span channels providing for a variable span distance between the forward and rearward pin openings.

To secure the linkage pins within the respective forward and rearward pin openings 190, 192, the forward and rearward pin openings may each be operatively associated with a pin clamp 194. The pin clamps 194 are separate, individual components that may be shaped as a generally rectangular block of steel or a similar rigid material. In an embodiment, the independent pin clamps 194 can be releasably attached to the first and second lower sidewalls 144, 146 with a plurality of threaded fasteners 196 such as threaded bolts. Disposed into a peripheral edge of pin clamp 194 can be a pin seat 198 that can have a generally semi-circular shape and can be dimensioned to correspond to the pin diameter of the linkage pin. The cylindrical linkage pins can therefore abut partially within the pin seats 198 when engaged. The semi-circular pin seats 198 provide the pin clamps 194 with a generally U-shaped profile.

To releasably attach the pin clamp 194 to the first and second lower sidewalls 144, 146 of the tool interface 120, the forward pin opening 190 can be associated with a first clamp block 200 and the rearward pin opening 192 can be associated with a second clamp block 202. The first clamp block 200 can be located toward or proximate to the rearward circumferential edges of the forward pin opening 190 and, like the pin clamps 194, can have a generally rectangular outline. To have the same profile as the forward pin openings 190 with which it is associated, the first clamp block 200 can also have a pin seat 204 disposed therein that dimensionally corresponds to the pin diameter of the linkage pins. The second pin block 202 can be located toward or proximate to the upper edge of the rearward pin openings 192 that may be formed as span channels. The second clamp blocks 202 can have a rectangular shape and can be generally coextensive in length with the span channels forming the pin openings. Because of the oblong shape of the span channels, the second clamp blocks 202 may not include the semi-circular pin seats 204 associated with the first pin blocks 200.

In use, a linkage pin may be slidably inserted through the axially aligned pair of forward pin openings 190, a clearance for which is provided by the semi-circular pin seat 204 of the first clamp block 200 in which the cylindrical exterior shape of the linkage pin is partially accommodated. The pin clamp 194 is arranged so that the pin seat 198 seats around and abuts the remaining exterior surface of the cylindrical linkage pin and the distal edges of the pin clamp 194 extend around and abut the first clamp block 200. First and second threaded fasteners 196 are inserted through corresponding fastener holes disposed in the pin clamp 194 and threadably engaged into corresponding threaded holes disposed in the first clamp block 200. A linkage pin is likewise inserted through the aligned rearward pin openings 192 and thus adjacent to the upwardly located second clamp block 202. The pin clamp 194 is arranged so that the pin seat 198 seats around and abuts the cylindrical exterior of the linkage pin and threaded fasteners 196 are similarly inserted through fastener holes in the pin clamp 194 and threaded holes in the second pin block 202. The threaded fasteners 196 can be tightened to securely engage the linkage pins along multiple points of contact between the pin clamps 194 associated with the first clamp block 200 and the pin clamps 194 associated with the second clamp block 202.

In an embodiment, the first lower sidewall 144 and the second lower sidewall 146 can each have an exterior face 206 and an interior face 208. The exterior faces 206 of the first and second lower sidewalls 144, 146 can be oppositely oriented with respect to each other toward the lateral outward sides of the adapter bracket 100. The interior faces 208 of the first and second lower sidewalls 144, 146 can be facing opposed to each other and spaced apart by the distance between the first and second lower sidewalls 144, 146. In the illustrated embodiment, the first and second clamp blocks 200, 202 can be located on the interior faces 208 of the first and second lower sidewalls 144, 146 and can be integrally formed thereon. In another embodiment, the first and second clamp blocks 200, 202 be located on the exterior faces 206 of the first and second lower sidewalls 144, 146 such that the pin clamps would be adjacent to the exterior faces 206 when attached to the respective first and second clamp blocks 200, 202. Accordingly, when connected, the first and second lower sidewalls 144, 146 may be disposed within or between the connection interface on the work tool or may be exteriorly adjacent to the connection interface.

Figure 8:
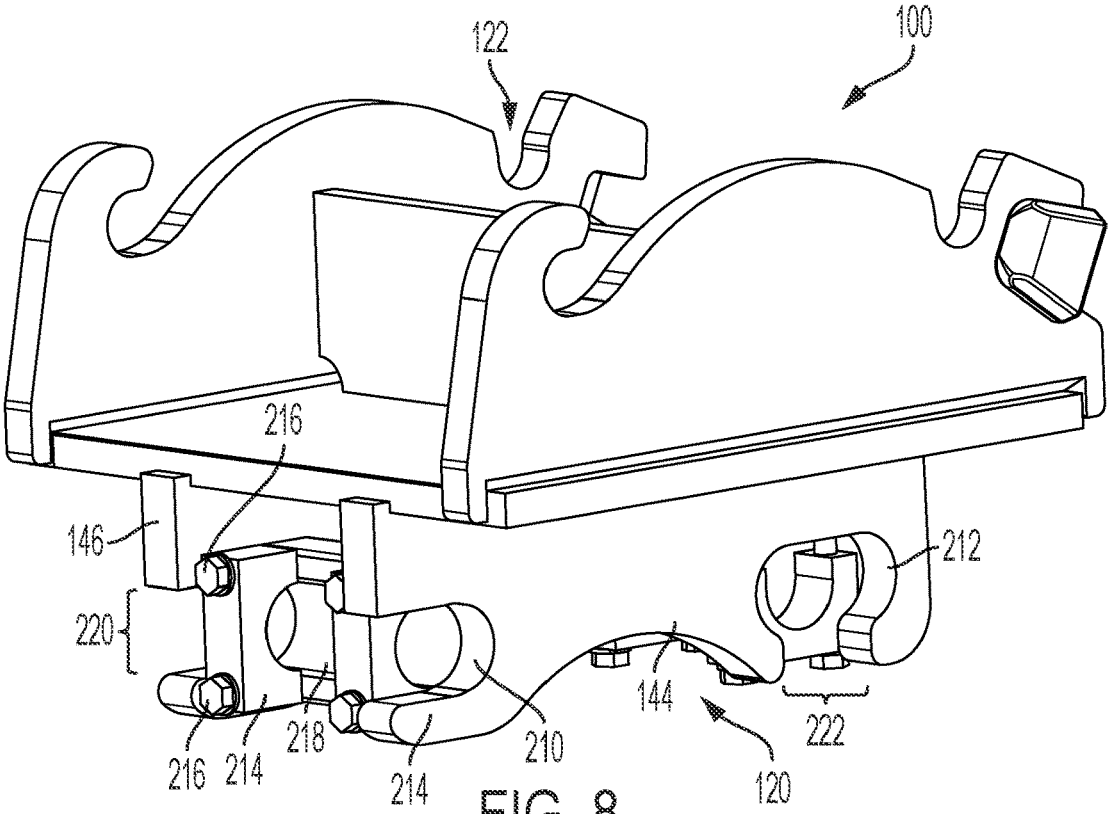
FIG. 8 is a forward isometric view of an embodiment of the adapter bracket wherein the forward and rearward pin openings are configured with open jaws to receive the linkage pins.
Figure 9:
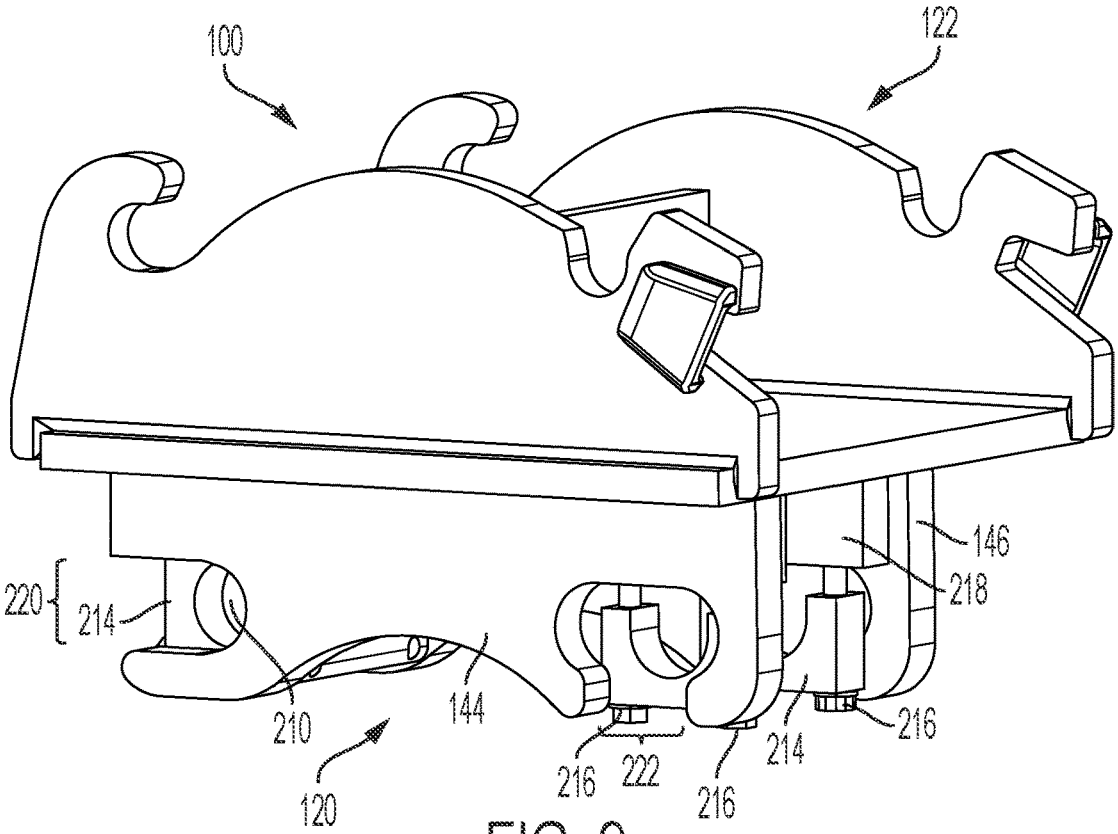
FIG. 9 is a rearward isometric view of the adapter bracket of FIG. 8.

Referring to FIGS. 8 and 9, there is illustrated another embodiment of the adapter bracket 100 configured to further facilitate reception and retention of the linkage pins. Similar to the previous embodiments, the adapter bracket 100 can include a lower tool interface 120 having a first lower sidewall 144 and a second lower sidewall 146 in a parallel, spaced apart arrangement, though in other embodiments the lower tool interface may be configured as single integral block. To securely attached to the linkage pins, the tool interface 120 can include a pair of forward pin openings 210 and a pair reward pin openings 212 disposed through each of the lower sidewalls 144, 146. In embodiment, the forward pin openings 210 can be configured as multi-radii pin openings and the rearward pin openings 212 can be configured as span channels. Further, the forward pin openings 210 and the rearward pin openings 212 can also be operatively associated with pin clamps 214 that can be threadably engaged via threaded fasteners 216 with corresponding clamp blocks 218 integrally formed on the surfaces of the first and second lower sidewalls 144, 146.

To enable the forward and rearward pin openings 210, 212 to receive the linkage pins, the forward and rearward pin openings 210, 212 can have an opened jaw configuration. For example, each forward and rearward pin 210, 212 includes bifurcated openings or respective first and second open jaws 220, 222 that are disposed through the material of the first and second lower sidewalls 144, 146 and that creates a passage through a peripheral edge of lower sidewalls. The first open jaw 220 associated with the forward pin opening 210 can be forward open jaw that is generally directed or extends forwardly with respect to the first and second lower sidewalls 144, 146 and the second open jaw 222 associated with the rearward pin opening 212 can be a downward open jaw that is generally directed or extends downwardly through the first and second sidewalls 144, 146.

In use, the pin clamps 214 that are associated with the forward and rearward pin openings 210, 212 can be detached from the respective clamp blocks 218 on the first and second lower sidewalls 144, 146 so that the first and second open jaws 220, 222 are unobstructed. The gap or space presented by the first and second open jaws 220, 222 can have any suitable dimensions but should be as wide as the diameter of the linkage pins. The linkage pins can be inserted into the forward and rearward pin openings 210, 212 through the gaps or spaces provided by first and second open jaws 220, 222. The pin clamps 214 can be reattached to the clamp blocks 218 to retentively secure the linkage pins in the forward and rearward pin openings 210, 212. A possible advantage of the embodiment of the adapter bracket 100 having open jaws 220, 222 is that the adapter bracket can be engaged with the linkage pins without uninstalling the linkage pins from the connection bracket on the work tool. In other words, the linkage pins can be inserted through the gaps or spaces provided by the first and open jaws 220, 222 by appropriately moving the adapter bracket 100 with respect to the linkage pins, as opposed to axially inserting the linkage pins through the forward and rearward pin openings 210, 212.

Figure 10:
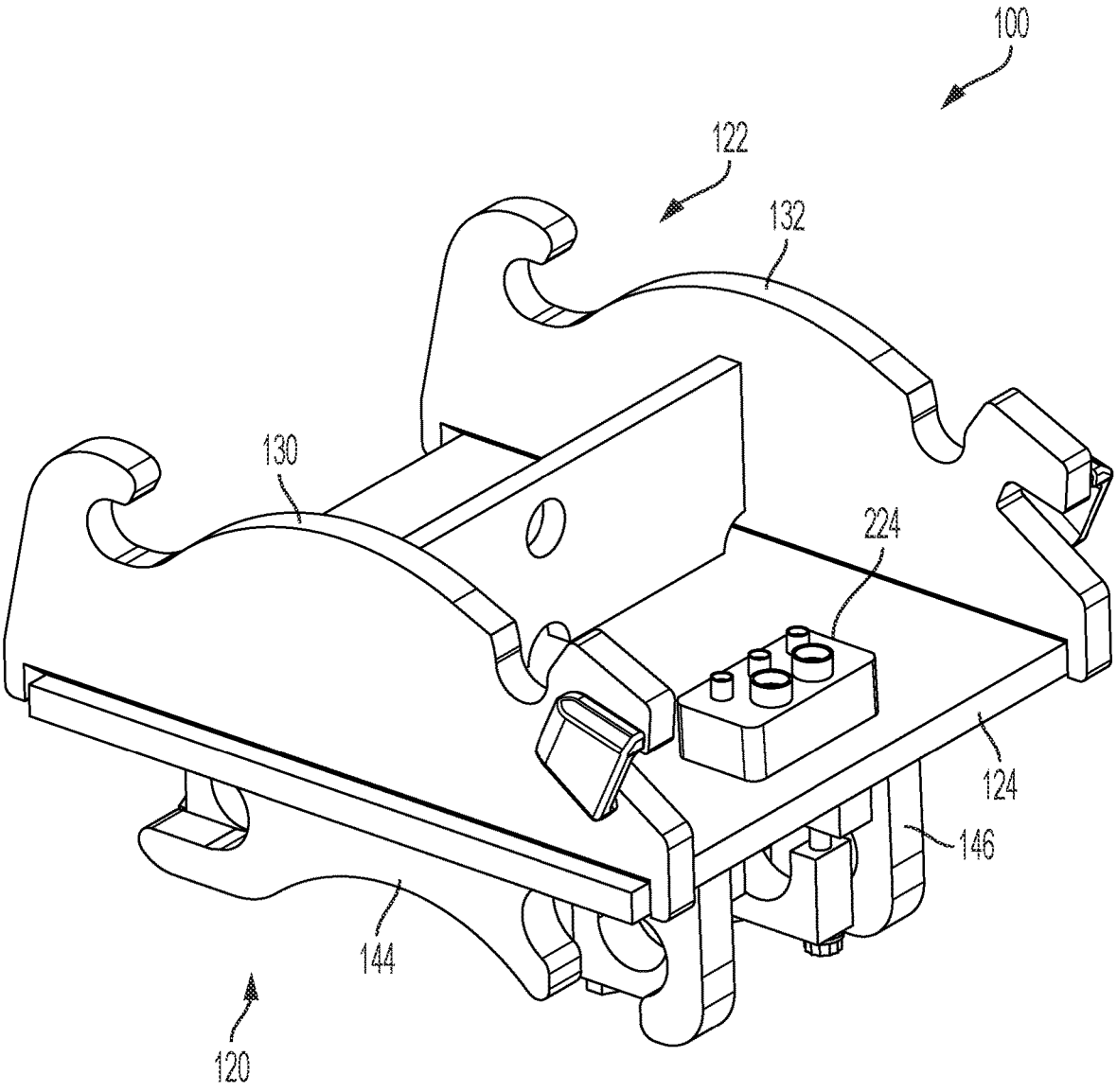
FIG. 10 is a rearward isometric view of an embodiment of the adapter bracket including a communication interface for the transfer or communication of fluids, power, data signals, etc. between the implement arm and the work tool.

Referring to FIG. 10, there is illustrated a further embodiment of the adapter bracket 100 configured to further facilitate operative interaction between the work machine and the work tool when coupled together. In some circumstances, it may be desirable to incorporate the work tool with a hydraulic system of the work machine, for example, if the work tool is a hydraulically driven hammer. To establish fluid communication between the work tool and hydraulic hoses or conduits on the implement arm, the adapter bracket can include a communications interface 224 that may include hydraulic hose fittings or channels for the passage of the pressurized hydraulic fluid. The communications interface 224 can be located on the adapter plate 124 that joins the tool interface 120 and the arm interface 122 of the adapter bracket 100. In the embodiment where the arm interface includes first and second sidewalls 130, 132, the communications interface 224 can be located between the upper sidewalls. In another embodiment, the communications interface 224 can be configured to communicate electricity and/or electric current between the work machine and the work tool, for example, to provide electrical power to the work tool or to exchange electronic data signals and communications with sensor on the work tool. In another embodiment, the communication interface 224 can be configured to communicate pressurized air or water to the work tool as part of a spraying system for dust control or the like.

INDUSTRIAL APPLICABILITY

The embodiments of the adapter brackets 100 of the disclosure are useful for coupling various work tools to the implement arm of a work machine. The adapter bracket 100 is configured for use with and to secure to linkage pins having different pin diameters and/or different pin spans. Accordingly, the adapter bracket 100 can be utilized with a variety of different OEM work tools and allows the same work machine to be used to efficiently and effectively conduct multiple different operations.

It will be noted that the terms "forward," "rearward," "upper," "lower" and the like are for referential and orientation purposes only and are not intended as an limitation on the disclosure. Those of skill in the art will recognize that the orientation of the adapter bracket are a matter of perspective and therefore terms of orientation are for reference only.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. An adapter bracket for coupling an implement arm of a work machine and a work tool, the adapter bracket comprising:

an adapter body having an arm interface and a tool interface, the tool interface including a first lower sidewall and a second lower sidewall each with a first non-circular pin opening and a second pin opening for receiving linkage pins of a connection interface on the work tool, wherein each of the first non-circular pin openings of the first and second lower sidewalls is configured to receive linkage pins having different diameters at different positions within the first non-circular pin opening;

wherein the first and second lower sidewalls each include a first surface portion defining at least a portion of the first non-circular pin opening;

at least one pin clamp configured to secure the linkage pins having different diameters at the different positions within each first non-circular pin opening, the pin clamp including a clamping member and a clamp actuator; and wherein the clamp actuator is configured to shift the clamping member relative to the first non-circular pin openings to engage the clamping member with a linkage pin extending in the first non-circular pin openings and clamp the linkage pin between the clamping member and the first surface portions of the first and second lower sidewalls to secure the linkage pin at one of the positions within the first non-circular pin openings.

2. The adapter bracket of claim 1, wherein the tool interface includes the first lower sidewall and the second lower sidewall that are spaced apart from each other, the first lower sidewall and the second lower sidewall each having formed there through the first non-circular pin opening and the second pin opening.

3. The adapter bracket of claim 2, wherein the first non-circular pin opening is configured as a multi-radii pin opening including a first arc having a minimum radius and a second arc having a maximum radius.

4. The adapter bracket of claim 2, wherein the second pin opening is configured as a span slot having a channel length that is dimensionally greater than a channel height.

5. The adapter bracket of claim 1, wherein the clamping member includes a pin seat for accommodating a circumferential surface of the linkage pin.

6. The adapter bracket of claim 5, wherein the pin clamp fastens to a clamp block formed at one of the first lower side or the second lower sidewall with threaded fasteners.

7. The adapter bracket of claim 6, wherein the first lower sidewall and the second lower sidewall each include an exterior surface and an interior surface, and the clamp block is formed on one of the exterior surface or the interior surface.

8. The adapter bracket of claim 2, wherein the first non-circular pin opening has a first open jaw and the second pin opening has a second open jaw.

9. The adapter bracket of claim 8, wherein the first open jaw is a forward open jaw and the second open jaw is a downward open jaw.

10. The adapter bracket of claim 1, wherein the first lower sidewall and the second lower sidewall each have a clearance cutout to avoid obstructions on the work tool.

11. The adapter bracket of claim 10, wherein the clearance cutout is a curved clearance cutout.

12. A coupler system for coupling an implement arm of a work machine and a work tool, the coupler system comprising:

a work tool having a connection interface including a first linkage pin and a second linkage pin in a parallel, spaced apart arrangement, an adapter bracket having an adapter body including a tool interface for releasable connection to the connection interface on the work tool and an arm interface for connection to the implement arm, the tool interface including:

a first lower sidewall and a second lower sidewall each with a first non-circular pin opening to securely receive the first linkage pin at different positions within the first non-circular pin opening and a second pin opening to securely receive the second linkage pin, wherein each of the first non-circular pin openings of the first and second lower sidewalls is configured to receive linkage pins having different diameters at different positions within the first non-circular pin opening-;

wherein the first and second lower sidewalls each include a first surface portion defining at least a portion of the first non-circular pin opening;

at least one pin clamp configured to secure the first linkage pin at one of the different positions within each first non-circular pin opening, the pin clamp including a clamping member and a clamp actuator;

wherein the clamp actuator is configured to shift the clamping member relative to the first non-circular pin openings to engage the clamping member with the first linkage pin extending in the first non-circular pin openings and clamp the first linkage pin between the clamping member and the first surface portions of the first and second lower sidewalls to secure the first linkage pin at one of the positions within the first non-circular pin openings.

13. The coupler system of claim 12, wherein the second pin opening includes a second non-circular pin opening.

14. The coupler system of claim 12, wherein the first non-circular pin opening is configured as a multi-radii pin opening including a first arc having a minimum radius and a second arc having a maximum radius.

15. The coupler system of claim 12, wherein the second pin opening is configured as a span slot having a channel length that is dimensionally greater than a channel height.

16. The coupler system of claim 12, wherein the at least one pin clamp includes a first pin clamp operatively associated the first non-circular pin opening to secure the first linkage pin therein and a second pin clamp operatively associated with the second pin opening to secure the second linkage pin therein.

17. The coupler system of claim 12, wherein the arm interface includes a first upper sidewall and a second upper sidewall that are spaced apart from each other and that are parallel to the first lower sidewall and the second lower sidewall.

18. The coupler system of claim 17, wherein the adapter body includes an adapter plate that joins the tool interface and the arm interface.

19. An adapter bracket for coupling an implement arm of a work machine and a work tool, the adapter bracket comprising:

an upper arm interface including a first upper sidewall and a second upper sidewall in a spaced apart relation, the upper arm interface including arm hooks for connection to the implement arm;

a lower tool interface for releasable connection to a connection interface on the work tool having a first linkage pin and a second linkage pin in a parallel, spaced apart relation, the lower tool interface including a first non-circular pin opening configured as a multi-radii pin opening and a second pin opening configured as a span channel having a channel length dimensionally greater than a channel height, wherein each of the first non-circular pin openings is configured to receive linkage pins having different diameters at different positions within the first non-circular pin opening;

a pin clamp configured to secure the first linkage pin at one of the different positions within the first non-circular pin opening, the pin clamp including a clamping member and a clamp actuator, wherein the clamp actuator is configured to shift the clamping member relative to the first non-circular pin opening to engage the clamping member with the first linkage pin extending in the first non-circular pin opening and secure the first linkage pin at the one position within the first non-circular pin openings.

20. The adapter bracket of claim 19 further comprising a second pin clamp to secure the second linkage pin at different positions within the second pin opening, the second pin clamp including a second clamping member and a second clamping actuator;

wherein the second clamp actuator is configured to shift the second clamping member relative to the second pin opening to engage the second clamping member with the second linkage pin extending in the second pin opening and secure the second linkage pin at one of the positions within the second pin openings.

* * * * *